US007665504B2

(12) United States Patent
Schulze

(10) Patent No.: US 7,665,504 B2
(45) Date of Patent: Feb. 23, 2010

(54) OVERHEAD DOOR BRACKET

(76) Inventor: Dale J. Schulze, 1979 Cassella-Montezuma Rd., Maria Stein, OH (US) 45860

( * ) Notice: Subject to any disclaimer, the term of this patent is extended or adjusted under 35 U.S.C. 154(b) by 617 days.

(21) Appl. No.: 11/065,028

(22) Filed: Feb. 25, 2005

(65) Prior Publication Data

US 2006/0191647 A1 Aug. 31, 2006

(51) Int. Cl.
*E05D 15/26* (2006.01)

(52) U.S. Cl. ..... 160/201; 16/DIG. 1

(58) Field of Classification Search ..... 160/201, 160/188, 189; 248/300, 224.8; 16/DIG. 1; 49/199, 200

See application file for complete search history.

(56) References Cited

U.S. PATENT DOCUMENTS

| | | | | |
|---|---|---|---|---|
| 1,767,575 | A * | 6/1930 | Bujack | 52/369 |
| 1,803,723 | A | 5/1931 | Murphy | |
| D249,225 | S * | 9/1978 | Moe | D8/330 |
| 4,628,636 | A | 12/1986 | Folger | |
| 4,805,344 | A * | 2/1989 | Hrboka | 49/280 |
| 5,001,861 | A * | 3/1991 | Hahn | 49/280 |
| 5,188,163 | A * | 2/1993 | Schwartzengraber et al. | 160/229.1 |
| D337,042 | S | 7/1993 | Lin et al. | |
| 6,273,174 | B1 | 8/2001 | Singleton | |
| 6,273,377 | B1 * | 8/2001 | Archer | 248/218.4 |
| 6,669,156 | B2 * | 12/2003 | East et al. | 248/300 |
| 2004/0144031 | A1 | 7/2004 | Ferreyra | |

OTHER PUBLICATIONS

"Liftmaster Door Bracket", website: http://www.residential-openers.com/lifchamsearc3.html, 1 page, printed from the Internet Jan. 26, 2005.

* cited by examiner

*Primary Examiner*—David Purol
(74) *Attorney, Agent, or Firm*—Richard C. Litman

(57) ABSTRACT

An overhead door bracket for attachment of the main arm of an overhead door opener to a metal overhead door for the purpose of opening and closing the door. The inventive bracket has a relatively wide mounting plate which spans the distance between the portions of the sheet metal doors having existing reinforcing backing strips for mounting of the hinges connecting the metal panels of the door. The inventive bracket has conventional connecting tabs spaced and extending outward to receive the lower end of the main arm of an opening system. The tabs have pin receiver bores for pivotally securing the main arm to the bracket by means of a pin. The bracket mounting plate has three spaced rows of mounting holes for mounting the bracket to the upper panel of a hinged door panel, the mounting holes being proximate the respective ends of the bracket.

11 Claims, 5 Drawing Sheets

OVERHEAD DOOR BRACKET

BACKGROUND OF THE INVENTION

1. Field of the Invention

The present invention relates to overhead door opening system. More particularly, the present invention relates to center brackets for attachment of the upper end portion of a metal overhead door to an opening system.

2. Description of the Related Art

The design of hinged-panel overhead doors is well known. Power operated door opening systems are popular and share a number of common features. Among these features is a main arm which attaches to a truck mounted on a track operated by a motor. The lower end of the arm is attached to the central upper portion of the door by means of a bracket mounted on the inside face of the door. Existing brackets have a relatively small mounting flange for mounting on wooden doors by means of screws. Existing brackets attached to sheet metal doors by screws are subject to separation from the door panels due to the thin, unsupported nature of the sheet metal. It would be desirable to provide a bracket which may be firmly attached to a sheet metal door with self-threading screws, avoiding the use of special attaching hardware such as throughbolts which require extra time to install and are unsightly. It would also be desirable to provide such a bracket which may be made in differing sizes for applications ranging from garage doors to industrial size overhead doors.

None of the above inventions and patents, taken either singly or in combination, is seen to describe the instant invention as claimed. Thus, a garage door bracket solving the aforementioned problems is desired.

SUMMARY OF THE INVENTION

The overhead door bracket of the present invention is a bracket for attachment of a main arm of an overhead door opener to a metal overhead door for the purpose of opening and closing the door. The inventive bracket has a relatively wide mounting plate which spans the distance between the portions of the sheet metal doors having existing reinforcing backing strips for mounting of the hinges connecting the metal panels of the door. The inventive bracket has conventional connecting tabs spaced and extending outward to receive the lower end of the main arm of an opening system. The tabs have pin receiver bores for pivotally securing the main arm to the bracket by means of a pin. The bracket mounting plate has three spaced rows of mounting holes for mounting the bracket to the upper panel of a hinged door panel, the mounting holes being proximate the respective ends of the bracket.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a bracket for attachment of an overhead door opener to a metal overhead door for the purpose of opening and closing the door. Existing brackets have a relatively small mounting flange for mounting on wooden doors by means of screws. Existing brackets attached to sheet metal doors by screws are subject to separation from the door panels due to the thin, unsupported nature of the sheet metal. The inventive bracket has a relatively wide mounting plate which spans the distance between the portions of the sheet metal doors having existing reinforcing backing strips for mounting of the hinges connecting the metal panels of the door.

Figure 1:
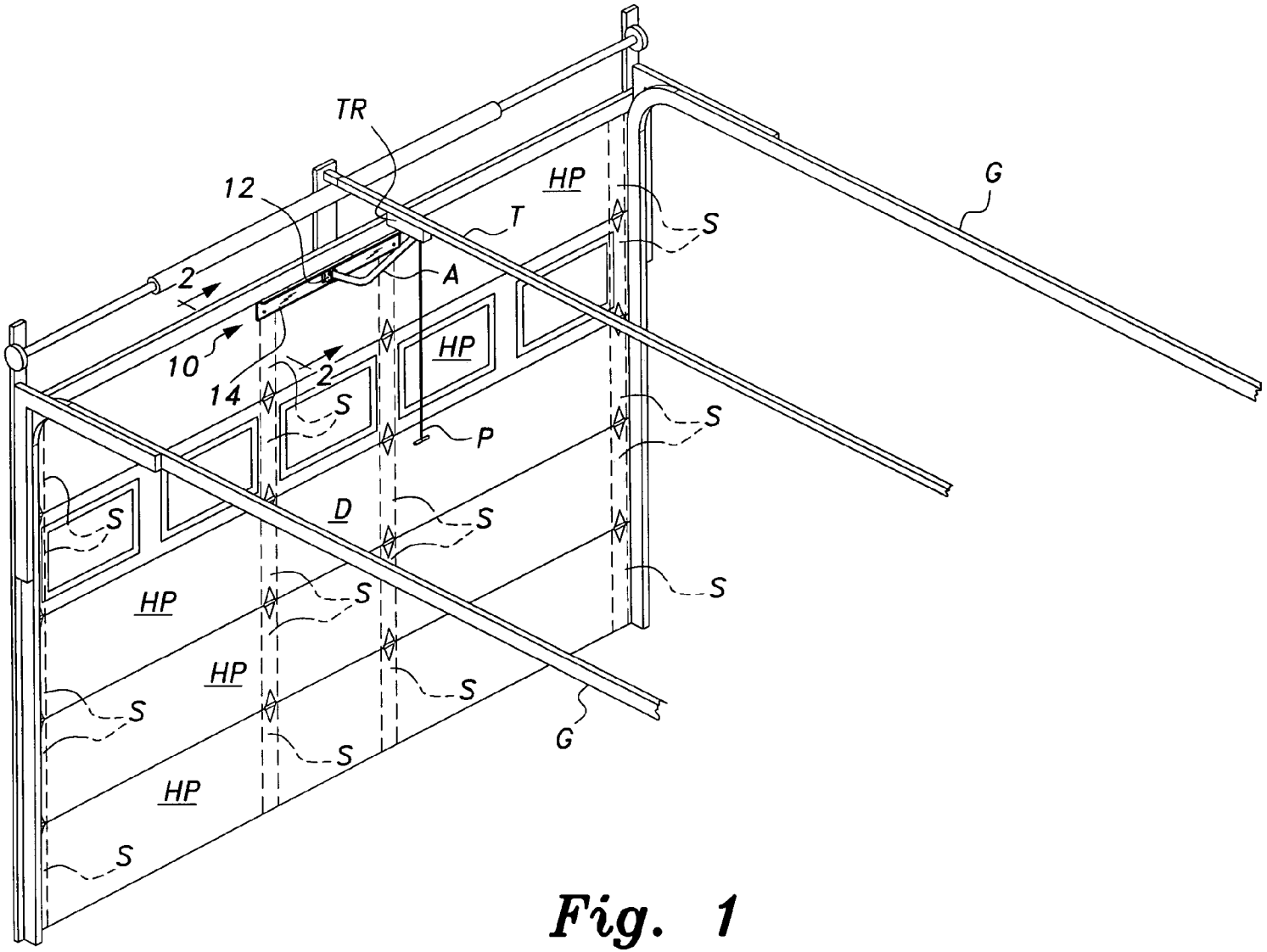
FIG. 1 is an environmental, perspective view of an overhead door bracket according to the present invention.
Figure 2:
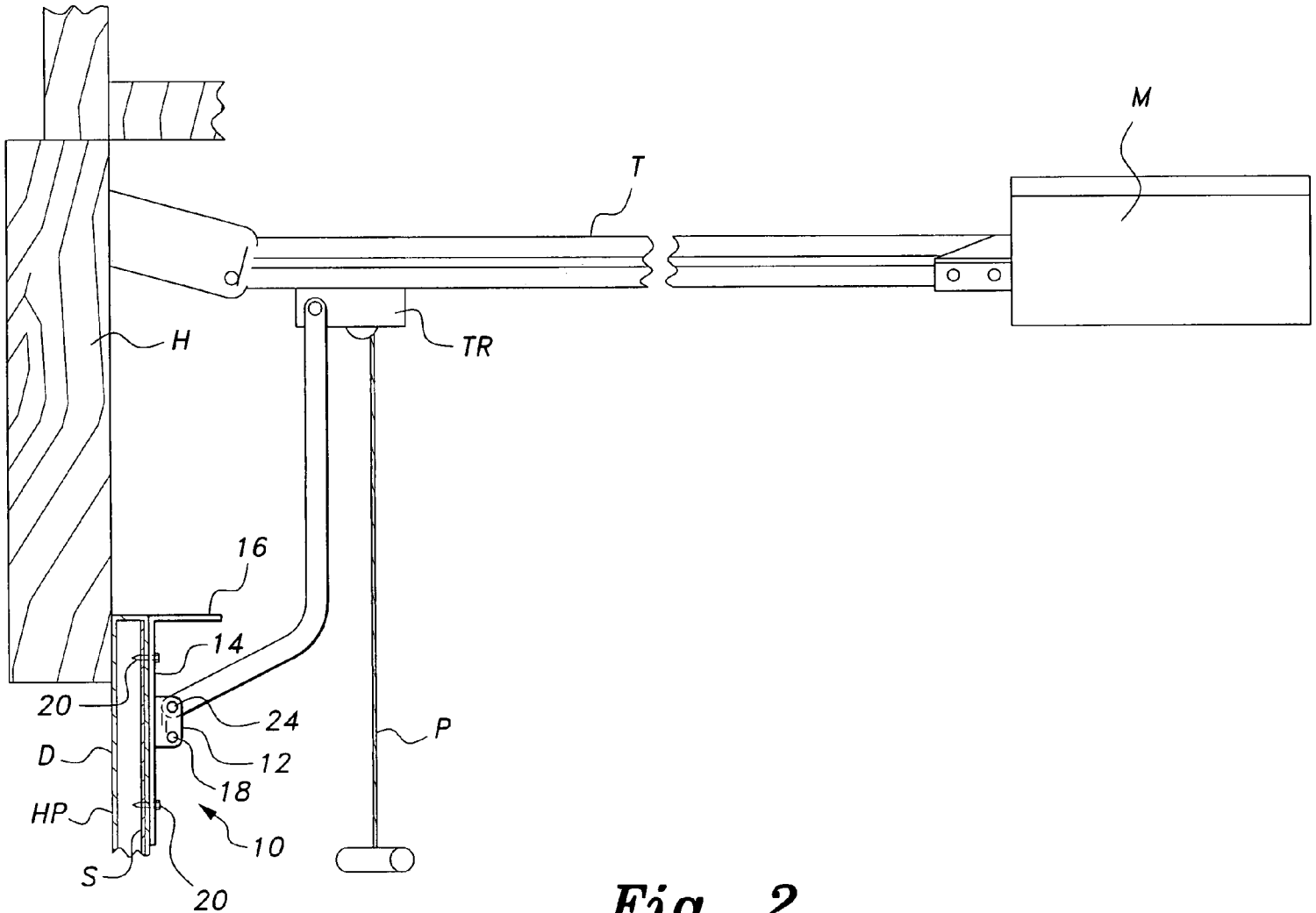
FIG. 2 is an environmental, sectional view of the overhead door bracket installation of FIG. 1 taken along lines 2-2 of FIG. 1.

Referring to FIGS. 1 and 2 there is shown an environmental perspective and an environmental sectional view of the overhead door bracket of the present invention referred to herein by the reference No. 10. Door bracket 10 is mounted on an overhead door D made up of horizontal hinged metal panels HP having rollers at opposite sides (not shown) which travel on roller guides G located in the upper interior of a building in a well-known configuration. The bracket 10 is attached to the upper central portion of the uppermost of panels HP.

Bracket 10 has a pair of connecting tabs 12, extending outward from a generally planar mounting plate 14 shown as rectangular in shape. Mounting plate 14 has a stiffener 16 formed along its upper edge and has a plurality of mounting holes 22 (see FIG. 3) proximate end portions 32 for mounting with screws 20 such as self-tapping sheet metal screws. Connecting tabs 12 extend outward from mounting plate 14 as attached to hinged panel HP to receive the lower end of main arm A of the door opening and closing system. Main arm A is attached at a lower end between one of two sets of pin receiver bores 18 in tabs 12 by means of a pin (see FIG. 3) extending through the lower end of main arm A and is connected at its upper end to a truck TR which moves along track T powered by motor M in a well known manner. Pull rope P is connected to truck TR for manually opening overhead door D.

Hinged panel HP is made of sheet metal such as sheet steel or aluminum of from about 27 gauge to about 20 gauge in thickness. The hinged panel HP has backing strips S, typically about 3½ inches in width, attached to the inside of the sidewall of the panel HP facing the interior of the garage and extending vertically from the upper edge. to the lower edge of the panel HP at locations where interconnecting hinges are mounted by screws or the like. The backing strips S are typically made of from about 14 gauge to 12 gauge steel sheet and are mounted to the sheet metal of panel HP by adhesive or mechanical means.

Figure 3:
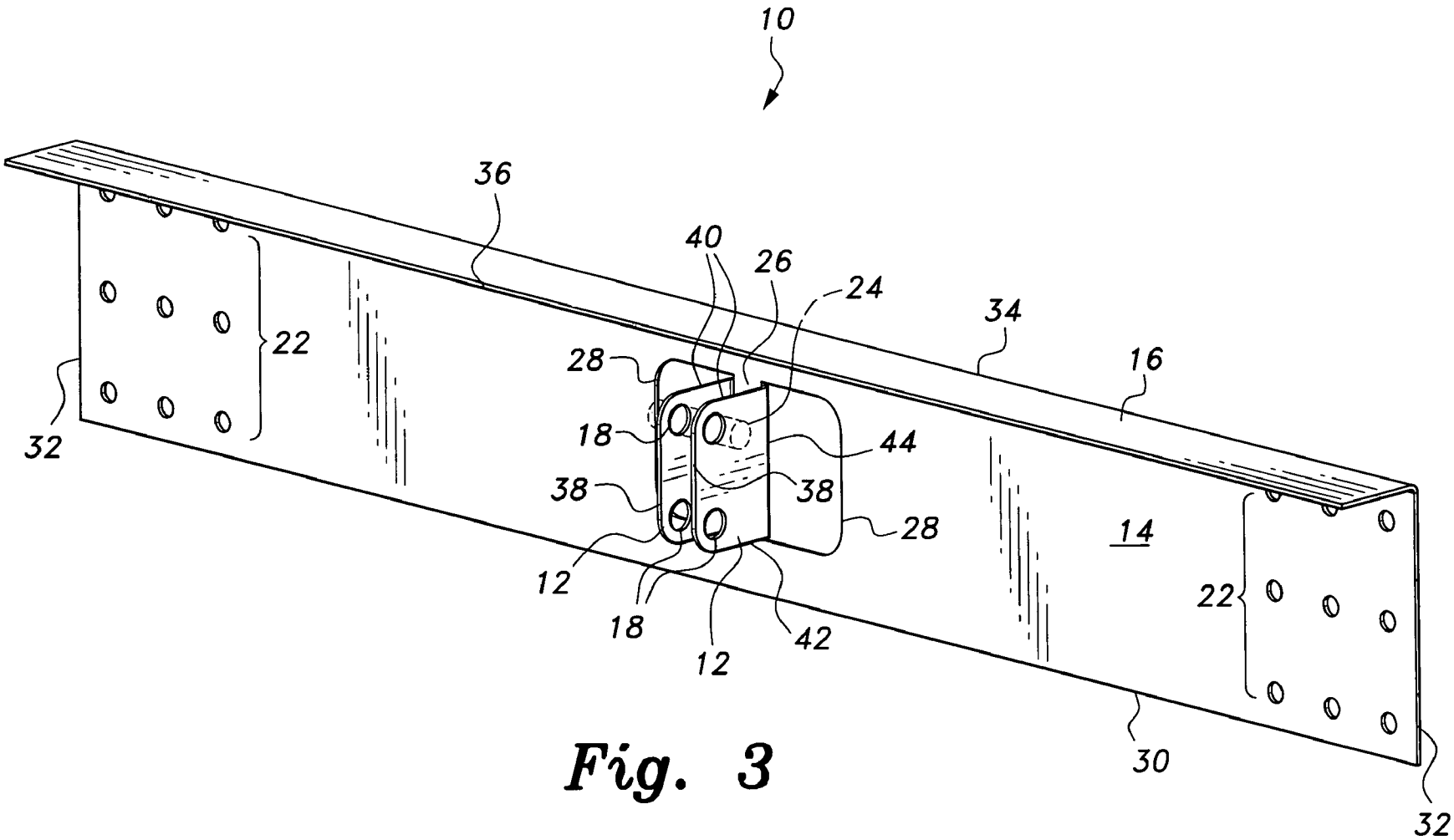
FIG. 3 is a perspective view of one embodiment of the overhead door bracket of FIG. 1.

Referring to FIG. 3, there is shown a perspective view of one embodiment of the invention wherein door bracket 10 has two spaced, generally rectangular parallel connecting tabs 12 extending outward from the central portion of mounting plate 14. Mounting plate 14 is rectangular planar imperforate sheet metal having a mount stiffener 16 extending outward therefrom along upper end 34 and having front edge 36. The stiffener 16 extends continuously from one end portion 32 to the opposite end portion 32. connecting tabs 12 each have two vertically spaced pin receiving bores 18 mutually aligned for selectively receiving a pin 24 to secure the lower end of main arm A (See FIG. 2), depending on the length and disposition of a particular arm A as installed (see FIG. 1). Mounting plate 14 forms connecting tab spacer 26 of at least the width of main arm A, determining the spacing of tabs 12 for receiving the main arm A. Further shown in FIG. 3 is the identical arrangement of mounting holes 22 at opposite end portion 32 of the mounting plate 14.

Connecting tabs 12 are generally rectangular in form having outer vertical edges 38 and horizontal upper and lower edges 40 and 42, respectively. Overhead door bracket 10 is preferably unitary in construction, connecting tabs 12 are preferably cut from the sheet material of mounting plate 14 and bent outward along rear bends 44 forming connecting tab voids 28 therein. Alternatively, connecting tabs 12 may be separately attached to mounting plate 14 by welding or mechanical means (not shown). Mounting plate 14 has a lower edge 30 extending between ends 32. Mounting plate 14 may be provided in varied lengths to bridge the gap between backing strips S for different doors. For greater widths, an additional stiffener 16 may be fashioned along lower edge 30 (see FIG. 4) to prevent bending and partial separation of the bracket 10 from the panel HP.

Mounting holes 22 are provided proximate the ends 32 of bracket 10 and preferably form at least three vertical rows, allowing the fitting of a single width of bracket 10 to be mounted on doors having differing spacing between backing strips S within a range (see FIGS. 1 and 2). The mounting holes 22 may be round, or laterally elongated for fine adjustment (see mounting holes 52 of FIG. 4.) and mounting is made by self-tapping screws (not shown) in a conventional manner.

Figure 4:
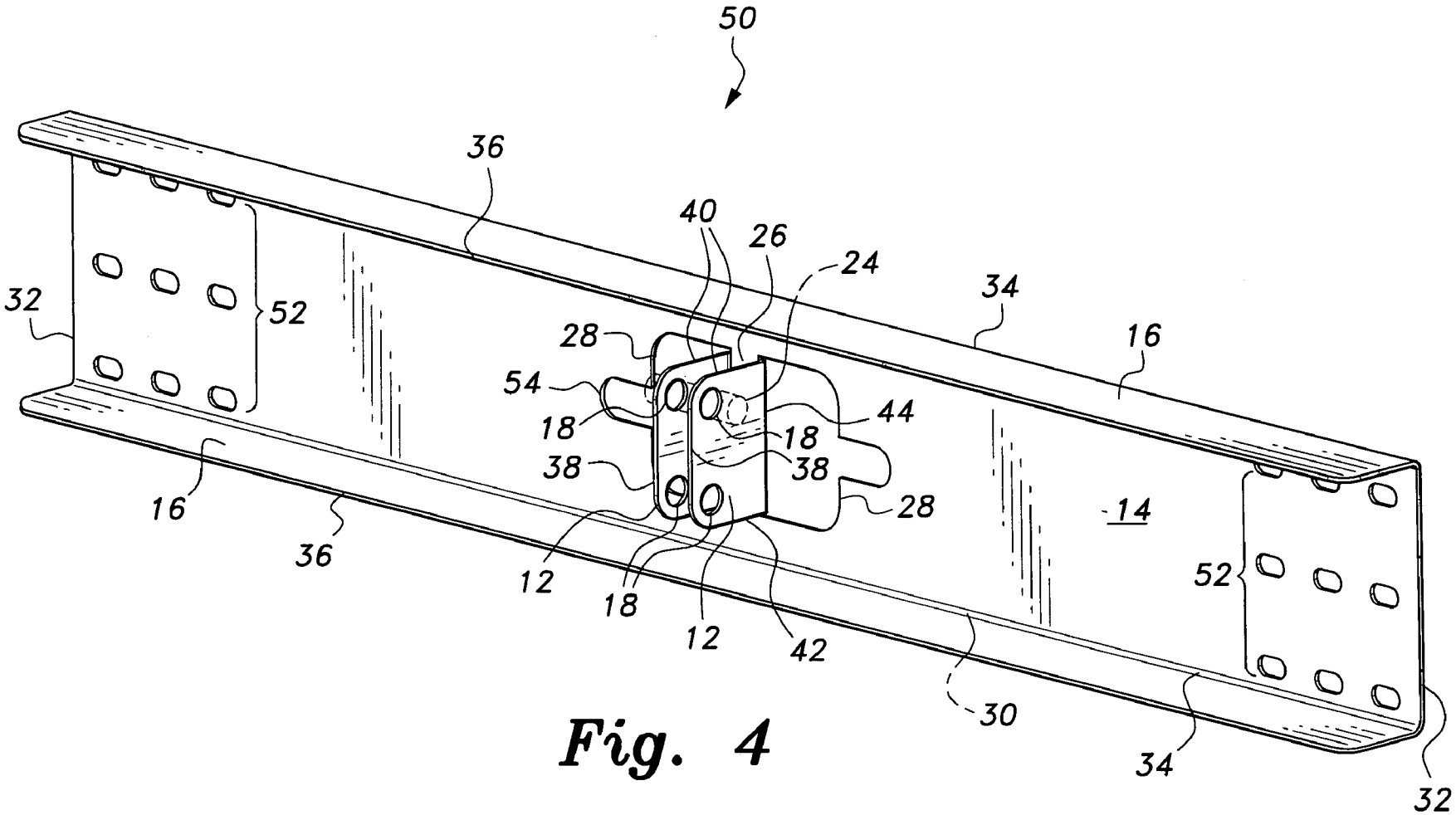
FIG. 4 is a perspective view of another embodiment of the overhead door bracket similar to that of FIG. 1.
Figure 5:
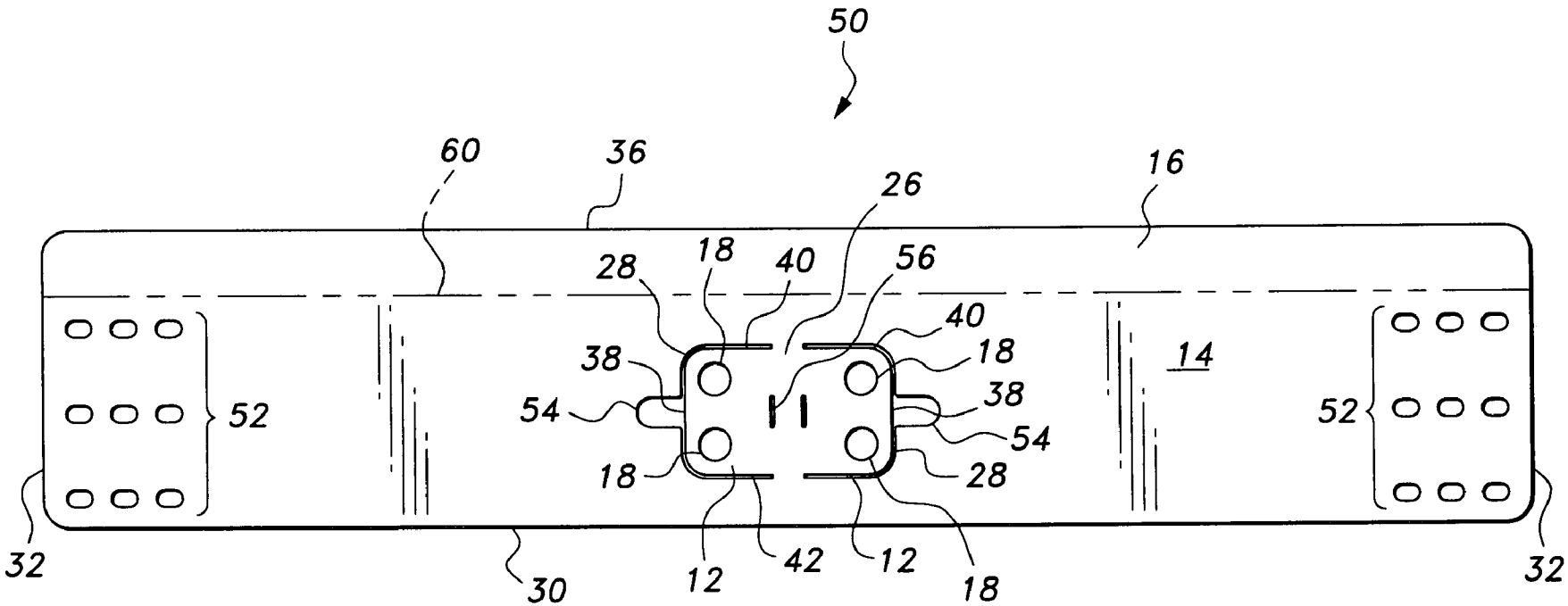
FIG. 5 is a plan view of a flat stamping for on-site forming of the overhead door bracket according to the present invention.

Referring to FIGS. 4 and 5, there is shown another embodiment of the inventive overhead door bracket referred to by element No. 50. Bracket 50 is similar to bracket 10 as discussed above, however bracket 50 may be provided in sheet form (FIG. 5) for bending at the job site to minimize storage space and ease handling. To this end, tabs 12 are cut from voids 28 in mounting plate 14 by a stamping process or the like. Access apertures 54 are cut from mounting plate 14, allowing easy access for the user to grasp tabs 12 and bend them outward for use. Bending guide punches 56 facilitate the accurate bending outward of tabs 12. A line may be scored for bending to form stiffener 16. Laterally elongated mounting holes 52 allow for fine width adjustment for the mounting of screws at backing strips S as described above. Bracket 10 may optionally include an additional stiffener 16 formed at the lower edge 30 of mounting plate 14 which may be bent outward to an angle of from about 30° to about 90° (as shown) from the mounting plate 14.

The bracket of the present invention may be made in widths from 10" to 120" and in vertical heights of from 2" to 24", depending on the application. As an example, a bracket may have and overall width of 26.0" and a height of 4.0" with three rows of mounting slots having centers spaced about 0.5", 1.25", and 2.0", respectively from each end. The stiffener extends about 1.0" outward from the mounting plate face. The connecting tabs are about 2.75" in height, extend outward about 2.75" from the mounting plate face, and are separated by about 0.75". The thickness of the sheet stock of the bracket is from about 18 gauge to about 10 gauge. The pin receiver bores in the connecting tabs are about 0.375" in diameter. Corners are radiused for appearance and to avoid snags. The stiffeners are preferably bent from the mounting plate face outward, the upper stiffener at an angle of about 90°, and the lower stiffener at an angle of about 30° to about 90°.

It is to be understood that the present invention is not limited to the embodiments described above, but encompasses any and all embodiments within the scope of the following claims.

I claim:

1. An overhead door bracket for a metal overhead door having vertical backing strips, comprising:

a generally rectangular mounting plate of unitary, one-piece construction having a central imperforate portion, an elongated upper edge, an elongated lower edge and opposite identical end portions, said mounting plate defining a plurality of mounting holes proximate each of the side edges of the end portions of the mounting plate and being located in a first plane and having a longitudinal direction;

a pair of connecting tabs extending perpendicularly outward from the central portion of said mounting plate and vertically aligned relative to the side edges of the mounting plate, wherein each of said connecting tabs is in a respective plane perpendicular to said first plane, each of said connecting tabs defining corresponding bores for receiving a main arm pin and being spaced a distance to receive the lower end of the main arm of a door opening system for connection by the main arm pin, said corresponding bores being aligned along the longitudinal direction; and a first stiffener extending outward from the upper edge of said mounting plate, wherein said stiffener extends continuously from one side edge to the opposite side edge;

wherein the mounting plate is of sufficient length such that when horizontally disposed over the metal overhead door, the mounting holes are positioned over a respective pair of the vertical backing strips for mounting by fasteners.

2. The bracket according to claim 1, wherein each of said connecting tabs defines a pair of mutually aligned, vertically spaced bores.

3. The bracket according to claim 1, further comprising a second stiffener extending outward from the lower edge of said mounting plate at an angle of from about 30° to about 90°.

4. The bracket according to claim 1, wherein said mounting plate defines three vertical rows of the mounting holes proximate each of the side edges.

5. The bracket according to claim 1, wherein said mounting plate defines a plurality of laterally elongated mounting holes for fine adjustment of said bracket relative to the vertical backing strips.

6. The bracket according to claim 1, wherein said connecting tabs are formed by bending them outward at a right angle from said mounting plate leaving a corresponding void adjacent each of said connecting tabs.

7. The bracket according to claim 6, wherein said mounting plate defines an access aperture opening into the respective void to facilitate in bending said connecting tabs outward from said mounting plate.

8. The bracket according to claim 6, wherein said mounting plate includes spaced bending guide punches for forming the right angle bends of said connecting tabs.

9. The bracket according to claim 1, wherein said mounting plate has a length of about 10 inches to about 120 inches.

10. The bracket according to claim 1, wherein said first stiffener extends from the upper edge of said mounting plate at an angle of about 90°.

11. An overhead door bracket in combination with an overhead door, comprising:

the overhead door having vertical backing strips;

a generally rectangular mounting plate of unitary construction having a central portion, an elongated upper edge, an elongated lower edge and opposite end portions, said mounting plate defining a plurality of mounting holes proximate each of the end portions and being located in a first plane and having a longitudinal direction, wherein the mounting plate is horizontally mounted to the vertical backing strips of the door;

a pair of connecting tabs extending perpendicularly outward from the central portion of said mounting plate and vertically aligned relative to the side edges of the end portions of the mounting plate, wherein each of said connecting tabs is in a respective plane perpendicular to said first plane, each of said connecting tabs defining corresponding bores for receiving a main lift arm pin and being spaced a distance to receive the lower end of the main lift arm of a door opening system for connection by the main lift arm pin, said corresponding bores being aligned along the longitudinal direction; and a first stiffener extending outward from the upper edge of said mounting plate, wherein said stiffener extends continuously from one side edge to the opposite side edge, wherein the mounting plate is of sufficient length such that when horizontally disposed over the metal overhead door, the mounting holes are positioned over a respective pair of the vertical backing strips for mounting by fasteners.

* * * * *